US008487184B2

(12) United States Patent
Rivernider, Jr. et al.

(10) Patent No.: US 8,487,184 B2
(45) Date of Patent: Jul. 16, 2013

(54) COMMUNICATION CABLE

(76) Inventors: James F. Rivernider, Jr., Ware, MA (US); George B. Munroe, IV, Goshen, MA (US)

( * ) Notice: Subject to any disclaimer, the term of this patent is extended or adjusted under 35 U.S.C. 154(b) by 219 days.

(21) Appl. No.: 12/954,389

(22) Filed: Nov. 24, 2010

(65) Prior Publication Data

US 2011/0127064 A1 Jun. 2, 2011

Related U.S. Application Data

(60) Provisional application No. 61/264,586, filed on Nov. 25, 2009.

(51) Int. Cl.
*H01B 11/02* (2006.01)
*H01B 11/00* (2006.01)

(52) U.S. Cl.
USPC ..... 174/106 R; 174/102 R; 174/68.1

(58) Field of Classification Search
USPC ..... 174/106 R, 113 R, 68.1, 110 R, 102 R, 174/107
See application file for complete search history.

(56) References Cited

U.S. PATENT DOCUMENTS

| | | | | | |
|---|---|---|---|---|---|
| 2,379,318 | A | | 6/1945 | Safford | |
| 4,408,089 | A | | 10/1983 | Nixon | |
| 4,510,346 | A | * | 4/1985 | Bursh et al. | 174/36 |
| 4,847,448 | A | * | 7/1989 | Sato | 174/103 |
| 5,061,823 | A | | 10/1991 | Carroll | |
| 5,216,202 | A | * | 6/1993 | Yoshida et al. | 174/36 |
| 5,329,064 | A | * | 7/1994 | Tash et al. | 174/36 |
| 5,393,929 | A | | 2/1995 | Yagihashi | |
| 5,554,236 | A | | 9/1996 | Singles | |
| 6,246,006 | B1 | * | 6/2001 | Hardin et al. | 174/106 R |
| 6,894,226 | B2 | | 5/2005 | Yokoi | |
| 7,034,228 | B2 | | 4/2006 | Yokoi | |
| 7,355,123 | B2 | | 4/2008 | Kimura | |
| 7,425,676 | B2 | | 9/2008 | Eng | |
| 8,026,441 | B2 | * | 9/2011 | Amato | 174/28 |
| 2008/0190642 | A1 | | 8/2008 | Allen | |
| 2008/0296038 | A1 | | 12/2008 | Eng | |
| 2010/0218970 | A1 | * | 9/2010 | Eshima | 174/108 |

* cited by examiner

*Primary Examiner* — Angel R Estrada
*Assistant Examiner* — Dimary Lopez
(74) *Attorney, Agent, or Firm* — Blodgett & Blodgett, P.C.; Gerry A. Blodgett; David J. Blodgett

(57) ABSTRACT

A signal transmission cable including a center core (10) of twisted pairs (10B) of insulated wires (10A). Then, a first layer of foamed polyolefin tape (11), which protects the core insulation from erosion by the shield materials, and distances them from the core so that the shield materials are more effective in their shielding. This distancing has the effect of allowing the continuous metal shielding layer to be thinner without losing shielding effectiveness. Then, a second layer of braided wire (12), angled at 45 degrees from the axis of the core. Third, a layer formed of a three-sub-layer laminate (13), The inner sub-layer is metallic aluminum (13A), attached to a middle sub-layer of polyester tape (13B). The outer surface of the polyester tape (13B) is metallized, that is, the outer surface of the polyester tape is impregnated with a very thin sublayer of aluminum (13C). Fourth, a jacket (14).

12 Claims, 3 Drawing Sheets

COMMUNICATION CABLE

CROSS-REFERENCE TO RELATED APPLICATIONS

This application claims the benefit under 35 U.S.C. section 119(e) of U.S. Provisional patent application No. 61/264,586 filed Nov. 25, 2009, all of which is hereby incorporated by reference.

STATEMENT REGARDING FEDERALLY SPONSORED RESEARCH OR DEVELOPMENT

This invention has been created without the sponsorship or funding of any federally sponsored research or development program.

REFERENCE TO SEQUENCE LISTING, A TABLE, OR A COMPUTER PROGRAM LISTING COMPACT DISK APPENDIX

Not applicable.

THE FIELD OF THE INVENTION

This invention involves a construction for use as a high flex life, double shielded, Cat 5e, Cat. 6, or Cat 6a, industrial patch cord for electrical signal transmission.

BACKGROUND OF THE INVENTION

There are many situations in which electrical signals must be communicated between two devices that are moving with respect to one another. This is typically accomplished by electrically connecting the devices using a communication cable, usually called a patch cord. Because the patch cord is normally exposed to flexing in various modes, and often at a very high frequency, the patch cords frequently fail in various ways. These failure modes can result in short circuits, loss of signal, or deterioration of signal.

What is needed is a light weight and cost effective, high flex, Ethernet type data cable that has dual shields for high shielding effectiveness. Paramount to a successful design will be the cable's ability to endure repetitive and continuous flexing through an unsupported bend radius. Testing will entail a sequence of 1 million flex cycles at 10× cable diameter and 10 million flex cycles at 20× cable diameter in a rolling bend without the benefit of a "C-Track" or mandrels to support the cable along it's length. A viable product will survive the flex test battery without visible physical damage and more importantly, will retain the original level of shielding effectiveness while also meeting or exceeding the industry accepted TIA 568B requirements for a Cat 5e, Cat. 6 and Cat 6a product.

Typical cable that is not intended for high flex applications will have a polyester tape around the core followed by a laminated foil tape and then the braid. In order to reduce signal loss and improve shielding effectiveness the laminated tape will usually be 0.002" or more thick. Unfortunately, the thicker the tape the more apt it is to crack. Once the internal tape on a traditional cable cracks, it produces sharp edges that will 'saw' on the core insulation during movement until it eventually causes cable shorting and/or failure. In some cases the shielding tape does not crack immediately, but will crease and fold. This folding will cause bending stress to be concentrated. That is the bend radius of the cable will actually become smaller where the foil is creased. This causes the wires in the core to exceed their bend radius limits and quickly fail. Where the bending stress is concentrated, the shield tape will often fail with a 360 degree crack which will reduce the shielding effectiveness. This interruption in the shield tape leads to lower conductivity (higher shield resistance) over the entire length of the cable. The braid applied to traditional cables is normally applied with a 20 to 40 degree angle. This construction will typically not perform well after a relatively low number of flex cycles because it doesn't allow the range of movement for the braid strands that the higher 45 degree angle braid of the cable of this invention provides.

In current high flex designs the foil is eliminated. Often a barrier layer of extruded material or a tape is applied over the core to prevent insulation abrasion by the braid movement. This construction eliminates the failures due to the tape however the cable will have lower shielding effectiveness at some frequencies when compared with a cable with a shield tape applied. One way to improve the shielding effectiveness is to manufacture a double shielded cable with two thick braids and no foil tape. This method results in a cable that is heavy and expensive.

These and other difficulties experienced with the prior art devices have been obviated in a novel manner by the present invention.

It is, therefore, an outstanding object of some embodiments of the present invention to provide a communication cable that is resistant to deterioration or failure caused by flexing.

It is a further object of some embodiments of the invention to provide a communication cable that is capable of being manufactured of high quality and at a low cost, enjoys minimum installation costs, provides highly effective function, and which is capable of providing a long and useful life with a minimum of maintenance.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

This invention involves a signal transmission cable including, starting from the center and moving outward, a core (10) is made up of one or more twisted pairs (10B) of insulated wires (10A), surrounded by a first layer of foamed polyolefin tape (11). This first layer (11) protects the core installation from erosion by the shield materials, and distances the shield materials from the core so that the shield materials are more effective in their shielding. This distancing has the effect of allowing the continuous metal shielding layer to be thinner while maintaining the same shielding effectiveness. The first layer (11) is then surrounded by a second layer of braided wire (12). The braid (12) is applied so that it is angled at 45 degrees from the axis of the core. Third, the braided wire (12) is surrounded by a layer formed of a three-sub-layer laminate (13). The inner sub-layer is metallic aluminum (13A). The metallic aluminum (13A) is attached to a middle sub-layer of polyester tape (13B). The outer surface of the polyester tape (13B) is metallized, that is, the outer surface of the polyester tape is impregnated with a very thin sublayer of aluminum (13C). Fourth, a plastic protective jacket surrounds the laminate (14).

The communication cables incorporating the principles of this invention provide superior resistance to electrical and physical deterioration caused by cyclic flexing of the cable, and can satisfy the requirements of Cat. 5e, Cat. 6, and Cat. 6a cable. Moving the shield layers away from the core allows maintenance of a required level of transmission performance while using a thinner layer of shielding.

BRIEF DESCRIPTION OF THE SEVERAL VIEWS OF THE DRAWING

The character of the invention, however, may best be understood by reference to one of its structural forms, as illustrated by the accompanying drawings, in which.

DETAILED DESCRIPTION OF THE INVENTION

Figure 1:
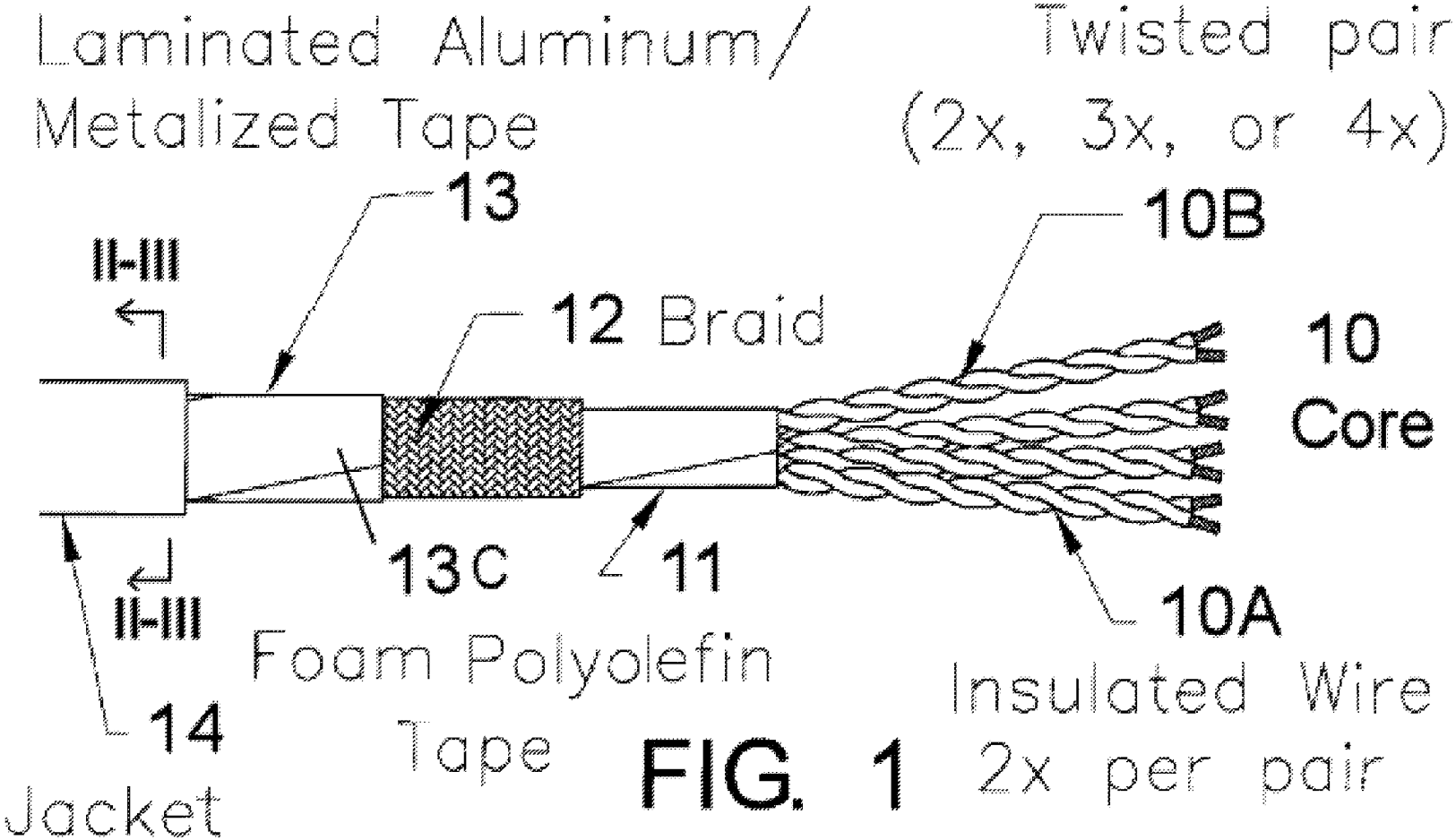
FIG. 1 is side view, with layers exposed, a communication cable embodying the principles of the present invention.
Figure 2:
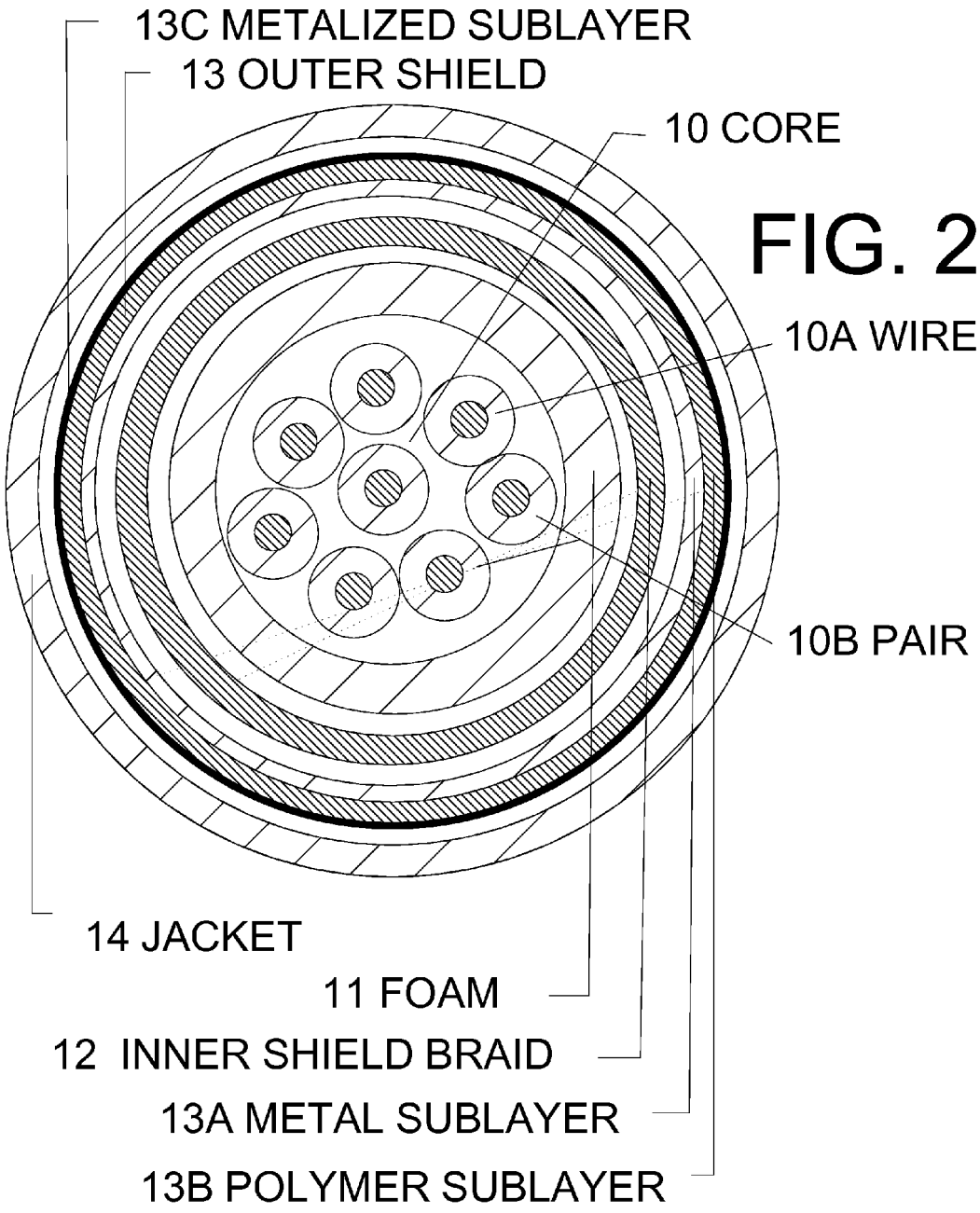
FIG. 2 is a cross-sectional view, taken along line I-II-I-II of FIG. 1, of one embodiment of the invention.
Figure 3:
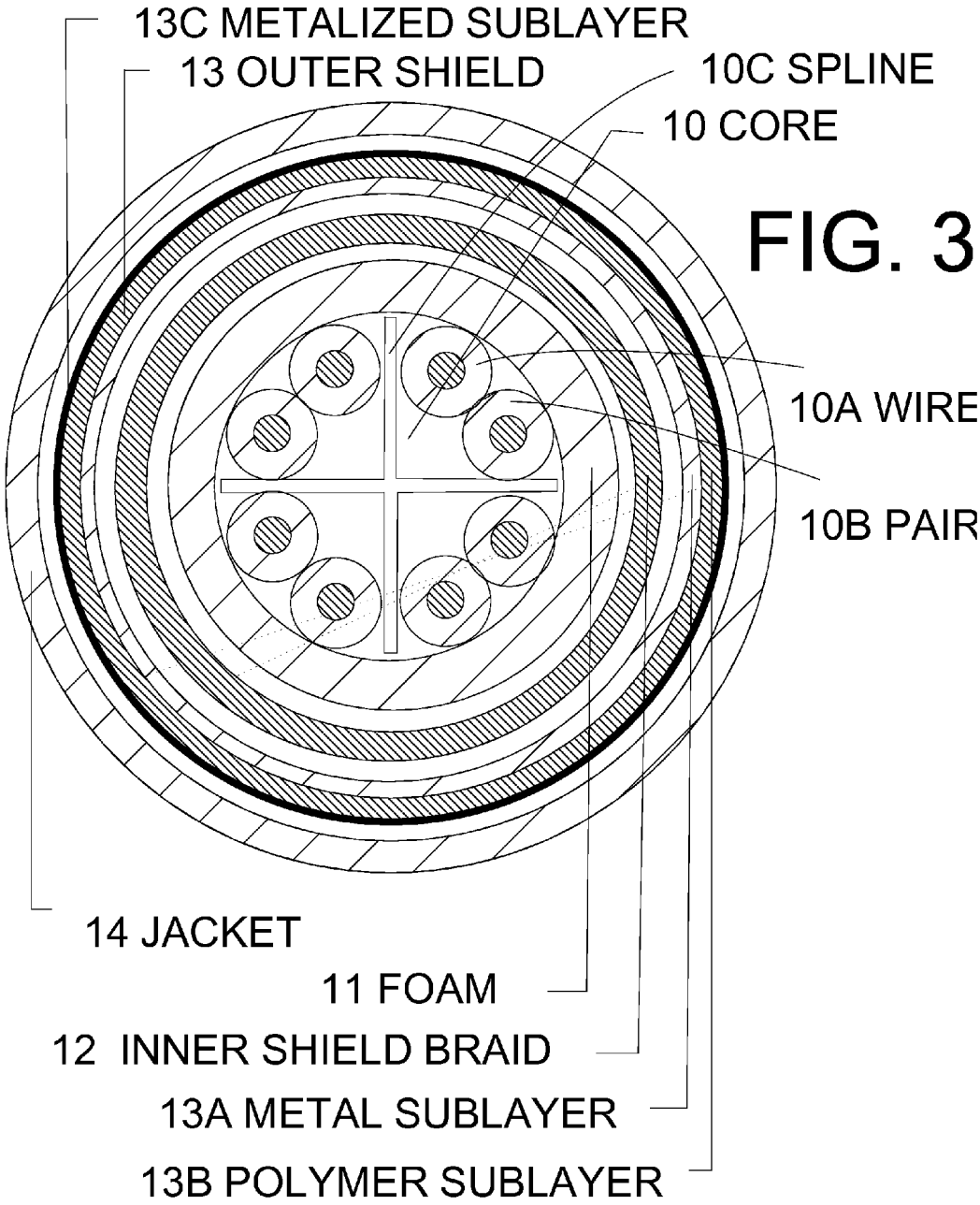
FIG. 3 is a cross-sectional view, taken along line I-II-I-II of FIG. 1, of another embodiment of the invention, that includes a spline in the core.

Referring first to FIG. 1 and which are shown the general features of one embodiment of the present invention, the invention involves a signal transmission or communication cable including, starting from the center and moving outward, a core (10) is made up of one or more twisted pairs (10B) of insulated wires (10A), surrounded by a first layer of foamed polyolefin tape (11). This first layer (11) protects the core installation from erosion by the subsequently-described shield materials, and distances those shield materials from the core so that the shield materials are more effective in their shielding. This distancing has the effect of allowing the continuous metal shielding layer to be thinner while maintaining the same shielding effectiveness. The first layer (11) is then surrounded by a second layer of braided wire (12). The braid (12) is applied so that it is angled at 45 degrees from the axis of the core. Third, the braided wire (12) is surrounded by a layer formed of a three-sub-layer laminate (13). The inner sub-layer is metallic aluminum (13A). The metallic aluminum (13A) is attached to a middle sub-layer of polyester tape (13B). The outer surface of the polyester tape (13B) is metallized, that is, the outer surface of the polyester tape is impregnated with a very thin sublayer of aluminum (13C). Fourth, a plastic protective jacket surrounds the laminate (14).

A typical embodiment of this invention would be a communication cable with 2 or 3 or 4 pair 26 through 22 AWG twisted pair (1) cable made up of two insulated wires (2) per pair. Pairs are twisted to reduce crosstalk as is standard. A foam polyolefin tape (3) is wrapped around the cable core which cushions and protects the core from the braid friction during movement of the cable. The polyolefin has a 0.009" wall thickness (+/1 0.002). This foam wrapped core is then braided (4) with 75% coverage at an atypical 45 degree braid angle. A laminated foil/metallized polyester tape (5) is applied in the non-traditional location of over the braided core. Lastly, a jacket (6) of PVC, TPE, TPU or other material is applied over the tape. The jacket is applied in a tube, semi pressure or pressure manner depending on the material and stripping force requirements determined for the product.

The new cable permits a double shield to be used while eliminating the flex failures of the shield tape and conductors. A foam polyolefin tape is applied over the core to prevent abrasion of the core insulation. This increases the effective distance of the pair from the shield which reduces the impact of the shield on the signal loss ensuring compliance with Cat 5e parameters. Braid is applied over this tape with a 45 degree angle rather than the traditional 20 to 40 degree angle to allow an unsupported cable (no mandrel) to bend smoothly. We picked 45 degrees so the inside and outside moved the same amount. Over the braid a very thin dual layer of laminated shield tape is applied. This is unique. It is not a common capability and not much reason to do it in most constructions. The polyester layer of this tape is metallized and laminated to aluminum. If the aluminum layer cracks, this metallized layer will provide some conductivity to limit the reduction is shielding effectiveness. If this thin a tape were applied inside the braid in the traditional manner the signal losses would increase, reducing the usable length of the cable and the cable may fail to meet the requirements of Cat 5e. One way around this with a traditional design would be to increase the diameter of the copper conductor, but this comes with an increase in the cost, size and weight of the product. Weight is an obstacle in a moving or continuous flex application. The stiffness and inertia of the cable makes it harder to control and reduces the density or number of cables that can fit into a space. Connectors also restrict the maximum OD of the cable.

You measure the angle of the braid as the angle off of the axis of the wire for both the clock-wise and counter clockwise strands. Zero degrees would be parallel to the cable and 90 degrees would be perpendicular. 45 degrees in both directions is optimum, but the variance can be +/−5 degrees and still be beneficial.

Here are more details about the structure and specification of the aluminum/metallized polyester layer. The preferred product is Neptco, Incorporated's NEPTAPE-brand 1001VM. 1001VM is a laminate with 0.00048" (12μ) thick metallized polyester film, and 0.00035" (9μ) thick aluminum foil. The metallized polyester layer provides some conductivity on the film (non-foil) side of the tape. Normally this thin shield would not work in a data cable application, because the resistance is too high due to the thinness of the layer of aluminum. To solve this we put the tape outside the braid, which reduces the current flowing in the tape, so less power is dissipated in the tape.

The thickness of the aluminum sub-layer (13A) is preferably 0.00035" (9μ) (normally the shielding layer would be 0.001" (25μ) to 0.0015" (38μ) thick in data cable). In this invention the sublayer should be less than 0.001" (25μ) thick, and preferably less than 0.0007" (18μ) thick, and more preferably less than 0.00047" (12μ) thick. Because the aluminum sub-layer (13A) is spaced further from the core than would normally be the case, the aluminum sub-layer is more effective in shielding the core from electro-magnetic radiation, and more effective at reducing degradation of transmission performance in the cable. This allows that sublayer (13A) to be thinner, while still maintaining the required level of electron-magnetic radiation shielding and while still maintaining the required level of transmission performance for the cable. The aluminum sublayer has a 26 AWG tinned copper drain wire in contact with the metallized surface.

Aluminum foil is on one side of the laminate, and is toward the braid. The order, moving outward, is braid, then aluminum foil, then glue, then polyester, then metallized surface layer.

The thickness of the polyester layer is 0.00048" (12μ) thick

The "metal" is Aluminum.

The "metal" preferably applied to the polyester by vacuum deposition, so it is a coating on the outer surface of the polyester.

The "metal" is impregnated into the polyester, so that it is a conductive or impregnated material.

Braid is 6 strands of 38 AWG tinned plated copper, could be 32 through 40 AWG bare or tinned. Bare is usually not used with aluminum foils because of tarnish.

Foam Polyolefin tape is Neptco-brand PP350 which is foam polypropylene tape.

Insulation is HDPE (high-density polyethylene). It could be polypropylene, or any thermoplastic or thermoset plastic.

Wire is 26 AWG 7/34 stranded tinned copper. Could be bare or 28 through 22 AWG at least.

While it will be apparent that the illustrated embodiments of the invention herein disclosed are calculated adequately to fulfill the object and advantages primarily stated, it is to be understood that the invention is susceptible to variation, modification, and change within the spirit and scope of the subjoined claims. It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

We claim:

1. A signal transmission cable, comprising:

a. a core (10) made up of one or more twisted pairs (10B) of insulated wires (10A), b. a first layer of foamed polyolefin tape (11), surrounding the core, c. a second layer of braided wire (12), surrounding the first layer (11), d. a third layer formed of a laminate (13), surrounding the second layer and comprising:

i. an inner sub-layer of metallic aluminum (13A), and ii. a sub-layer of polyester tape (13B), to which the metallic aluminum (13A) is attached, and, e. a plastic protective jacket (14) that surrounds the laminate (13).

2. A signal transmission cable, as recited in claim 1, wherein the first layer is adapted to protect the core installation from erosion by subsequent layers.

3. A signal transmission cable, as recited in claim 1, wherein the first layer is adapted to distance the subsequent layers from the core.

4. A signal transmission cable, as recited in claim 1, wherein the second and third layers are shielding layers, and the first layer is adapted to distance the shielding layers from the core, so that the shielding layers are more effective in their shielding, and more effective in reducing degradation of transmission performance.

5. A signal transmission cable, as recited in claim 1, wherein the second and third layers are shielding layers, and the first layer is adapted to distance the shielding layers from the core, so that the shielding layers are more effective in their shielding, and more effective in reducing degradation of transmission performance, so that distancing has the effect of allowing the shielding layers to be thinner while maintaining the same shielding effectiveness and transmission performance.

6. A signal transmission cable, as recited in claim 1, wherein the braid (12) is applied so that it is angled at 45 degrees (+/−5 degrees) from the axis of the core.

7. A signal transmission cable, as recited in claim 1, wherein the third layer is formed of a three-sub-layer laminate (13), surrounding the second layer, the outer surface of the polyester tape (13B) being metallized to form the third sub-layer, that is, the outer surface of the polyester tape is impregnated with a very thin sublayer of aluminum (13C).

8. A signal transmission cable, as recited in claim 1, wherein inner sub-layer of metallic aluminum (13A), 0.00035" (9μ) thick.

9. A signal transmission cable, as recited in claim 1, wherein inner sub-layer of metallic aluminum (13A), less than 0.001" (25μ) thick.

10. A signal transmission cable, as recited in claim 1, wherein inner sub-layer of metallic aluminum (13A), less than 0.0007" (18μ) thick.

11. A signal transmission cable, comprising:

a. the core (10) made up of one or more twisted pairs (10B) of insulated wires (10A), b. a first layer of foamed polyolefin tape (11), surrounding the core (10), c. a second layer of braided wire (12), surrounding the first layer, to form a first shielding layer, and applied so that it is angled at 45 degrees (+/−5 degrees) from the axis of the core, d. a third layer formed of a three-sub-layer laminate (13), surrounding the second layer, to form a second and third shielding layer, the laminate comprising, i. an inner sub-layer of metallic aluminum (13A), that is 0.00035" (9μ) thick, ii. a middle sub-layer of polyester tape (13B), to which the metallic aluminum (13A) is attached, and iii. a outer surface of the polyester tape (13B) that is metallized, that is, the outer surface of the polyester tape is impregnated with a very thin sublayer of aluminum (13C), and e. a plastic protective jacket surrounding the laminate (14), wherein the first layer (11) protects the core installation from erosion by the shield layers, and distances the shield layers from the core so that the shield layers are more effective in their shielding, so that this distancing has the effect of allowing the shielding layers to be thinner while maintaining the same shielding effectiveness.

12. A signal transmission cable, comprising:

a. the core (10) made up of one or more twisted pairs (10B) of insulated wires (10A), b. a first layer of foamed polyolefin tape (11), surrounding the core (10), c. a second layer of braided wire (12), surrounding, adjacent, and in contact with the first layer, to form a first shielding layer, and applied so that it is angled at 45 degrees (+/−5 degrees) from the axis of the core, d. a third layer formed of a three-sub-layer laminate (13), surrounding, adjacent, and in contact with the second layer, to form a second and third shielding layer, the laminate comprising, i. an inner sub-layer of metallic aluminum (13A), that is 0.00035" (9μ) thick, ii. a middle sub-layer of polyester tape (13B), to which the metallic aluminum (13A) is attached, and iii. a outer surface of the polyester tape (13B) that is metallized, that is, the outer surface of the polyester tape is impregnated with a very thin sublayer of aluminum (13C), and e. a plastic protective jacket surrounding, adjacent, and in contact with the laminate (14), wherein the first layer (11) protects the core installation from erosion by the shield layers, and distances the shield layers from the core so that the shield layers are more effective in their shielding, so that this distancing has the effect of allowing the shielding layers to be thinner while maintaining the same shielding effectiveness.

* * * * *